US007446735B2

(12) United States Patent
Kim et al.

(10) Patent No.: US 7,446,735 B2
(45) Date of Patent: Nov. 4, 2008

(54) PLASMA DISPLAY PANEL DRIVING METHOD AND PLASMA DISPLAY

(75) Inventors: Jin-Sung Kim, Suwon-si (KR); Woo-Joon Chung, Suwon-si (KR); Seung-Hun Chae, Suwon-si (KR); Kyoung-Ho Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 702 days.

(21) Appl. No.: 10/947,106

(22) Filed: Sep. 21, 2004

(65) Prior Publication Data

US 2005/0078061 A1 Apr. 14, 2005

(30) Foreign Application Priority Data

Sep. 22, 2003 (KR) ..... 10-2003-0065549

(51) Int. Cl.
*G09G 3/28* (2006.01)

(52) U.S. Cl. ..... 345/60; 345/40; 345/42; 345/63; 345/66; 345/67; 345/68; 315/169.1; 315/169.3

(58) Field of Classification Search ..... 345/41, 345/42, 60–72
See application file for complete search history.

(56) References Cited

U.S. PATENT DOCUMENTS 5,818,175 A * 10/1998 Yoshioka et al. ..... 315/169.4
6,252,568 B1 * 6/2001 Iseki et al. ..... 345/60
6,294,875 B1 9/2001 Kurata et al.
6,956,331 B2 * 10/2005 Lee et al. ..... 315/169.1
7,068,244 B2 * 6/2006 Nagao et al. ..... 345/60

FOREIGN PATENT DOCUMENTS

JP 2001-228821 8/2001

OTHER PUBLICATIONS

Patent Abstract of Japan for Publication No. 2001-228821, Date of publication of application Aug. 24, 2001, in the name of Shinji Masuda et al.

* cited by examiner

*Primary Examiner*—Richard Hjerpe
*Assistant Examiner*—Jennifer T Nguyen
(74) *Attorney, Agent, or Firm*—Christie, Parker & Hale, LLP

(57) ABSTRACT

In a plasma display panel driving method, a final voltage of a falling ramp voltage is reduced to a voltage for firing a discharge at all the discharge cells in a reset period. A difference between a voltage at an address electrode of a discharge cell to be selected and a voltage applied to a scan electrode is established to be greater than a maximum discharge firing voltage in an address period. A voltage greater than a sustain voltage is applied to the scan electrode so as to convert positive wall charges which can be formed on the scan electrode of a discharge cell which is not selected in the address period into negative wall charges.

11 Claims, 9 Drawing Sheets

PLASMA DISPLAY PANEL DRIVING METHOD AND PLASMA DISPLAY

CROSS REFERENCE TO RELATED APPLICATION

This application claims priority to and the benefit of Korea Patent Application No. 2003-65549 filed on Sep. 22, 2003 in the Korean Intellectual Property Office, the content of which is incorporated herein by reference.

BACKGROUND OF THE INVENTION (a) Field of the Invention

The present invention relates to plasma display panels (PDPs), and, more particularly, to a driving method therefor.

(b) Description of the Related Art

A PDP is a flat display for showing characters or images using plasma generated by gas discharge. PDPs can include pixels numbering more than several million in a matrix format, in which the number of pixels are determined by the size of the PDP. Referring to FIGS. 1 and 2, a PDP structure will now be described.

FIG. 1 shows a partial perspective view of the PDP, and FIG. 2 schematically shows an electrode arrangement of the PDP.

As shown in FIG. 1, the PDP includes glass substrates 1, 6 facing each other with a predetermined gap therebetween. Scan electrodes 4 and sustain electrodes 5 in pairs are formed in parallel on glass substrate 1. Scan electrodes 4 and sustain electrodes are covered with dielectric layer 2 and protection film 3. A plurality of address electrodes 8 is formed on glass substrate 6, and address electrodes 8 are covered with insulator layer 7. Barrier ribs 9 are formed on insulator layer 7 between address electrodes 8, and phosphors 10 are formed on the surface of insulator layer 7 and between barrier ribs 9. Glass substrates 1, 6 are provided facing each other with discharge spaces between glass substrates 1, 6 so that scan electrodes 4 and sustain electrodes 5 can cross address electrodes 8. Discharge space 11 between address electrode 8 and a crossing part of a pair of scan electrodes 4 and sustain electrodes 5 forms discharge cell 12, which is schematically indicated.

As shown in FIG. 2, the electrodes of the PDP have an n×m matrix format. Address electrodes $A_1$ to $A_m$ are arranged in a column direction, and n scan electrodes $Y_1$ to $Y_n$ and n sustain electrodes $X_1$ to $X_n$ are arranged in a row direction. Scan/sustain driving circuit 13 drives the scan and sustain electrodes, while address driving circuit 15 drives the address electrodes.

U.S. Pat. No. 6,294,875 by Kurata for driving a PDP discloses a method for dividing one field into eight subfields and applying different waveforms in the reset period of the first subfield and the second to eighth subfields.

As shown in FIG. 3, a subfield includes a reset period, an address period, and a sustain period. A ramp waveform which gradually rises from voltage $V_p$ of less than a discharge firing voltage to voltage $V_r$ that is greater than the discharge firing voltage is applied to scan electrodes $Y_1$ to $Y_n$ during the reset period of the first subfield. Weak discharges are generated to address electrodes $A_1$ to $A_m$ and sustain electrodes $X_1$ to $X_n$ from scan electrodes $Y_1$ to $Y_n$ while the ramp waveform rises. Negative wall charges are accumulated to scan electrodes $Y_1$ to $Y_n$, and positive wall charges are accumulated to address electrodes A1 to Am and sustain electrodes $X_1$ to $X_n$ because of the discharges. The wall charges are actually formed on protection film 3 on scan electrodes 4 and sustain electrodes 5 in FIG. 1, but the wall charges are described as being generated on scan electrodes 4 and sustain electrodes 5 below for ease of description.

A ramp voltage which gradually falls from voltage $V_q$ of less than the discharge firing voltage to voltage 0V (volts) is applied to scan electrodes $Y_1$ to $Y_n$. A weak discharge is generated on scan electrodes $Y_1$ to $Y_n$ from sustain electrodes $X_1$ to $X_n$ and address electrodes $A_1$ to $A_m$ by a wall voltage formed at the discharge cells while the ramp voltage falls. Part of the wall charges formed on sustain electrodes $X_1$ to $X_n$, scan electrodes $Y_1$ to $Y_n$, and address electrodes $A_1$ to $A_m$ are erased by the discharge, and they are established to be appropriate for addressing. In a like manner, the wall charges are actually formed on the surface of insulator layer 7 of address electrode 8 in FIG. 1, but they are described as being formed on address electrode 8 for ease of description.

Next, when positive voltage $V_w$ is applied to address electrodes $A_1$ to $A_m$ of the discharge cells to be selected, and 0V is applied to scan electrodes $Y_1$ to $Y_n$ in the address period, addressing is generated between address electrodes $A_1$ to $A_m$ and scan electrodes $Y_1$ to $Y_n$, and between sustain electrodes $X_1$ to $X_n$ and scan electrodes $Y_1$ to $Y_n$ by the wall voltage caused by the wall charges formed during the reset period and positive voltage $V_w$. By the addressing, positive wall charges are accumulated on scan electrodes $Y_1$ to $Y_n$, and negative wall charges are accumulated on sustain electrodes $X_1$ to $X_n$ and address electrodes $A_1$ to $A_m$. Sustaining is generated on the discharge cells on which the wall charges are accumulated by the addressing, by a sustain pulse applied during the sustain period.

A voltage level of the last sustain pulse applied to scan electrodes $Y_1$ to $Y_n$ during the sustain period of the first subfield corresponds to voltage $V_r$ of the reset period, and voltage ($V_r$-$V_s$) corresponding to a difference between voltage $V_r$ and sustain voltage $V_s$ is applied to sustain electrodes $X_1$ to $X_n$. A discharge is generated from scan electrodes $Y_1$ to $Y_n$ to address electrodes $A_1$ to $A_m$ because of the wall voltage formed by the addressing, and sustaining is generated from scan electrodes $Y_1$ to $Y_n$ to sustain electrodes $X_1$ to $X_n$ in the discharge cells selected in the address period. The discharges correspond to the discharges generated by the rising ramp voltage in the reset period of the first subfield. No discharge occurs in the discharge cells which are not selected since no addressing is provided in the discharge cells.

In the reset period of the second following subfield, voltage $V_h$ is applied to sustain electrodes $X_1$ to $X_n$, and a ramp voltage which gradually falls from voltage $V_q$ to 0V is applied to scan electrodes $Y_1$ to $Y_n$. That is, the voltage which corresponds to the falling ramp voltage applied during the reset period of the first subfield is applied to scan electrodes $Y_1$ to $Y_n$. A weak discharge is generated on the discharge cells selected in the first subfield, and no discharge is generated on the discharge cells that are not selected.

In the reset period of the last following subfield, the same waveform as that of the reset period of the second subfield is applied. An erase period is formed after the sustain period in the eighth subfield. A ramp voltage which gradually rises from 0V to voltage $V_e$ is applied to sustain electrodes $X_1$ to $X_n$ during the erase period. The wall charges formed in the discharge cells are erased by the ramp voltage.

As to the above-described conventional driving waveforms, discharges are generated on all the discharge cells by the rising ramp voltage in the reset period of the first subfield, and accordingly, the discharges problematically occur in the cells which are not to be displayed, thereby worsening the contrast ratio. Further, since the addressing is sequentially performed on all scan electrodes in the address period of using an internal wall voltage, the internal wall voltage of scan electrodes that are selected in the later stage is lost. The lost wall voltage reduces margins as a result.

SUMMARY OF THE INVENTION

In accordance with the present invention a PDP driving method is provided for performing addressing without using an internal wall voltage. A PDP driving method is also provided for applying part of pulses as those having a voltage greater than a sustain voltage during a sustain period to solve the problem of cells which are not reset in a reset period.

In one aspect of the present invention, a method is provided for driving a PDP having a plurality of first electrodes and second electrodes respectively formed in parallel on a first substrate, and a plurality of third electrodes which cross the first and second electrodes and are formed on a second substrate. A discharge cell is formed by the adjacent first, second, and third electrodes. A field is divided into a plurality of subfields and then driven. Each subfield includes a reset period, an address period, and a sustain period, and all the subfields respectively configure at least one field. A ramp voltage which gradually falls from a first voltage to a second voltage is applied to the first electrode, during the reset period. A third voltage and a fourth voltage are respectively applied to the first electrode and the third electrode of a discharge cell to be selected from among the discharge cells, during the address period. A fifth voltage is alternately applied to the first and second electrodes, and a sixth voltage which has a gradually rising interval is applied to the first electrode in at least one of intervals for applying the fifth voltage to the second electrode after applying the fifth electrode to the first electrode, during the sustain period.

In another aspect of the present invention, a method is provided for driving a PDP having a plurality of first electrodes and second electrodes respectively formed in parallel on a first substrate, and a plurality of third electrodes which cross the first and second electrodes and are formed on a second substrate. A discharge cell is formed by the adjacent first, second, and third electrodes. A field is divided into a plurality of subfields and then driven, each subfield including a reset period, an address period, and a sustain period, and all the subfields respectively configuring at least one field. A ramp voltage which gradually falls from a first voltage to a second voltage is applied to the first electrode, during the reset period. A third voltage and a fourth voltage are respectively applied to the first electrode and the third electrode of a discharge cell to be selected from among the discharge cells, during the address period. A fifth voltage is alternately applied to the first and second electrodes, and at least one sixth voltage which rises from the fifth voltage is applied instantly after applying the fifth electrode to the first electrode, during the sustain period. The sixth voltage is greater than the fifth voltage.

In still another aspect of the present invention, a method is provided for driving a PDP having a plurality of first electrodes and second electrodes respectively formed in parallel on a first substrate, and a plurality of third electrodes which cross the first and second electrodes and are formed on a second substrate. A discharge cell is formed by the adjacent first, second, and third electrodes. During the sustain period, a first voltage is alternately applied to the first and second electrodes, and a second voltage which gradually rises is applied to the first electrode in at least one of intervals for applying the first voltage to the second electrode after applying the first voltage to the first electrode. The positive wall charges provided on the first electrode of the cell which is not selected in the address period for selecting a cell to be selected are converted into negative wall charges by applying the second voltage.

In further another aspect of the present invention, a method is provided for driving a PDP having a plurality of first electrodes and second electrodes respectively formed in parallel on a first substrate, and a plurality of third electrodes which cross the first and second electrodes and are formed on a second substrate. A discharge cell is formed by the adjacent first, second, and third electrodes. During the sustain period, a first voltage is alternately applied to the first and second electrodes, and at least one second voltage which rises from the first voltage is applied instantly after applying the first voltage to the first electrode. The positive wall charges provided on the first electrode of the cell which is not selected in the address period for selecting a cell to be selected are converted into negative wall charges by applying the second voltage.

In still further another aspect of the present invention, a plasma display includes: a first substrate; a plurality of first electrodes and second electrodes facing the first substrate with a gap; a second substrate; a plurality of third electrodes crossing the first and second electrodes and being formed on the second substrate; and a driving circuit for applying a driving voltage to the first, second, and third electrodes so as to discharge a discharge cell formed by the adjacent first, second, and third electrodes. The driving circuit alternately applies a first voltage to the first and second electrodes, and applies a second voltage in at least one of intervals for applying the first voltage to the second electrode after applying the first voltage to the first electrode during a sustain period. The second voltage is greater than the first voltage to convert positive wall charges provided on the first electrode of a cell which is not selected in an address period for selecting a cell to be discharged into negative wall charges.

DETAILED DESCRIPTION

Figure 4:
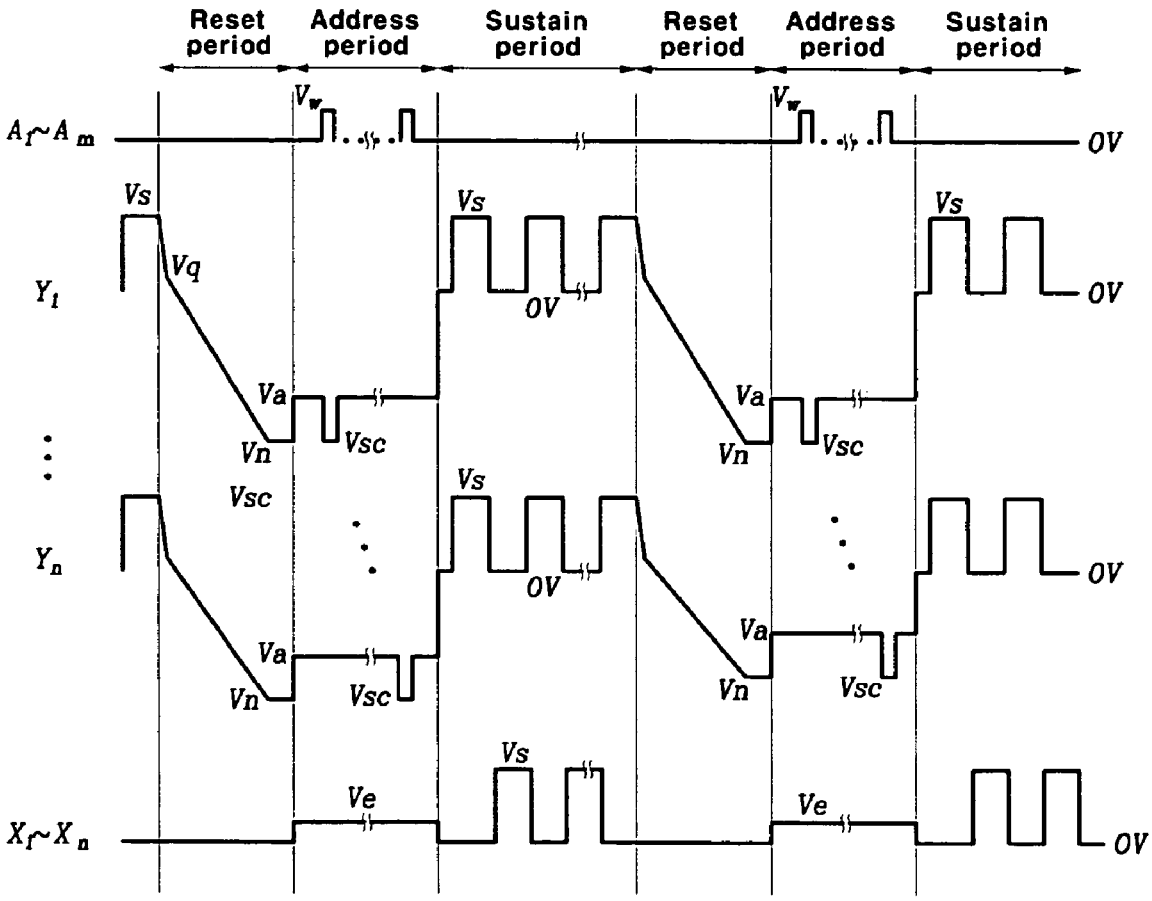
FIG. 4 shows a PDP driving waveform diagram according to a first exemplary embodiment of the present invention.

Referring to FIG. 4, a PDP driving method according to a first exemplary embodiment of the present invention will be described. Notations of reference numerals as address electrodes $A_1$ to $A_m$, scan electrodes $Y_1$ to $Y_n$, and sustain electrodes $X_1$ to $X_n$ represent that the same voltage is applied to address electrodes, scan electrodes, and sustain electrodes, and notations of reference numerals as address electrodes $A_i$ and scan electrodes $Y_j$ represent that a corresponding voltage is applied to some of address electrodes and scan electrodes.

Figure 1:
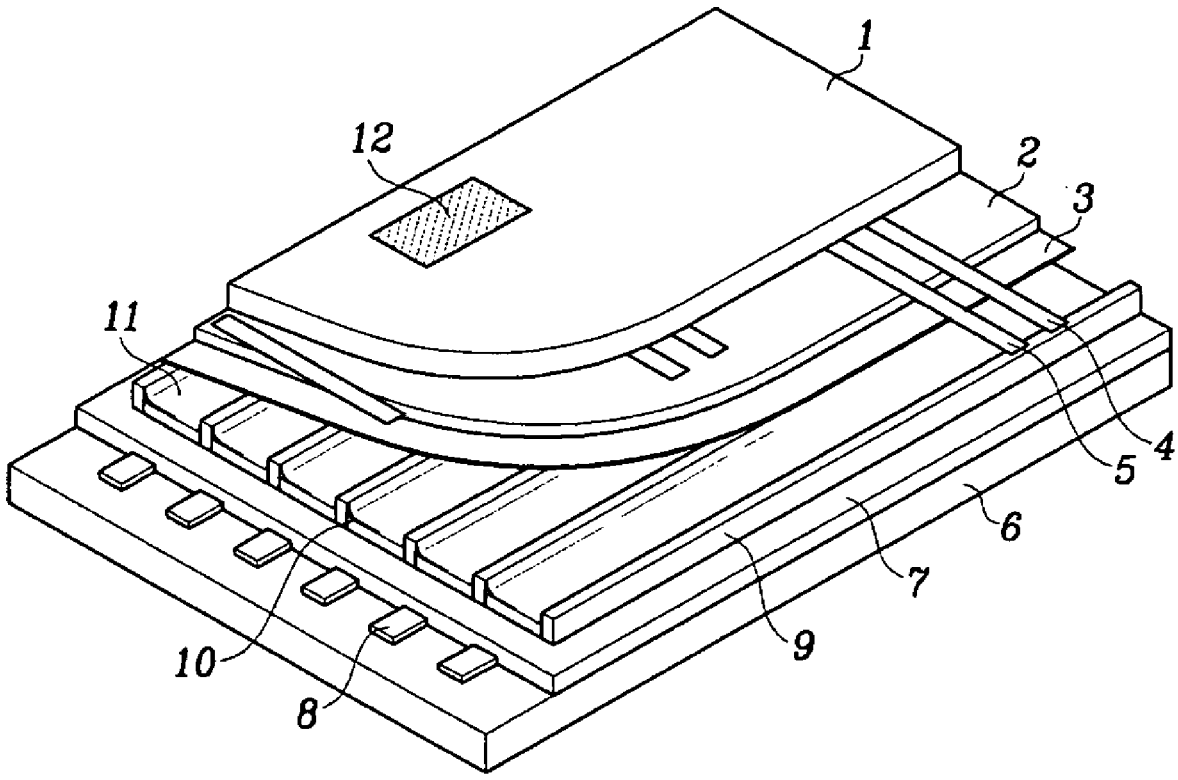
FIG.1 (Prior Art)
FIG. 1 shows a simplified perspective view of a general PDP.
Figure 2:
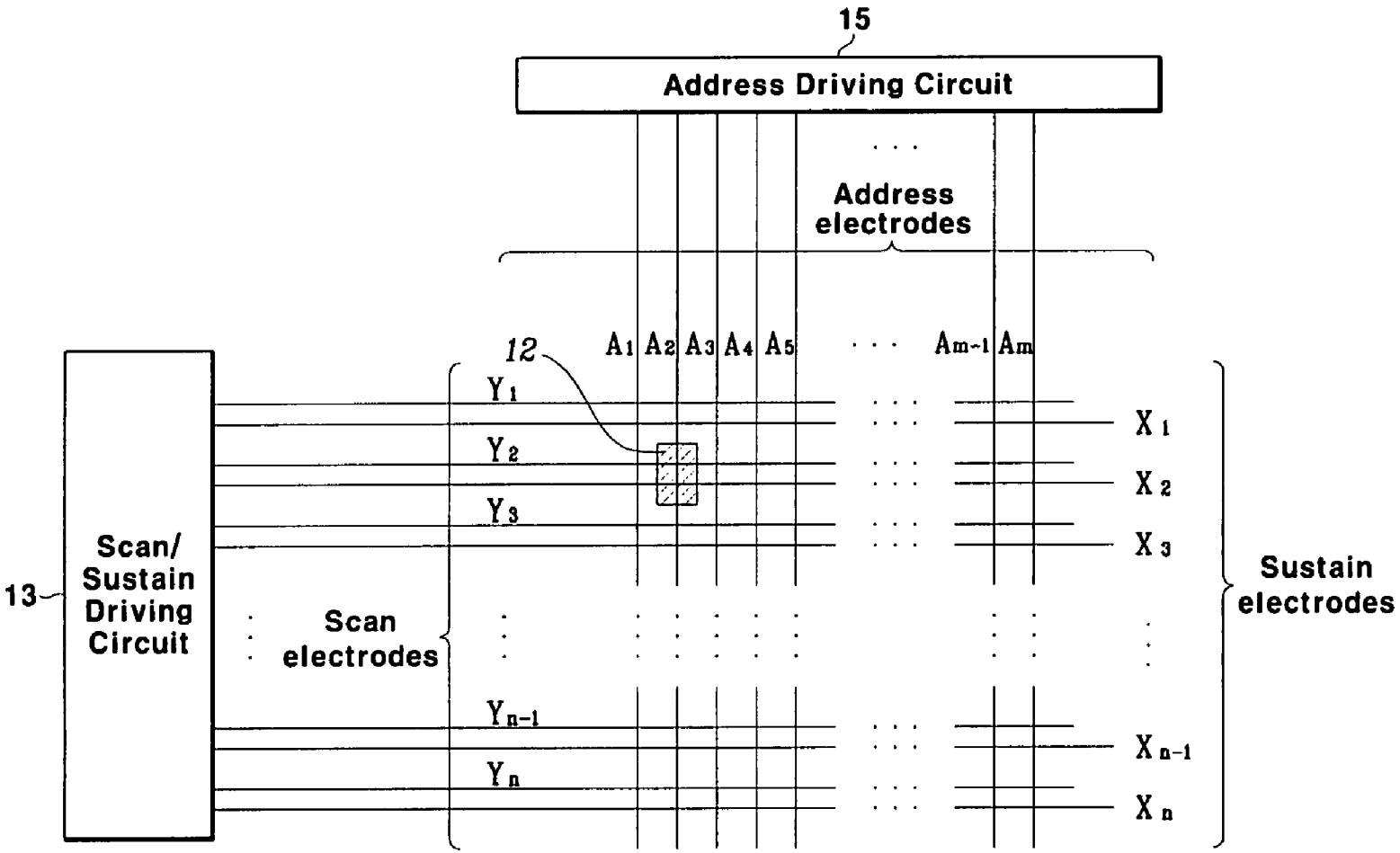
FIG.2 (Prior Art)
FIG. 2 shows an electrode arrangement diagram of a general PDP.

FIG. 4 shows a PDP driving waveform diagram according to a first exemplary embodiment of the present invention. As shown, the driving waveform according to the first exemplary embodiment includes a reset period, an address period, and a sustain period. As shown in FIG. 2, the PDP is coupled to scan/sustain driving circuit 13 for applying a driving voltage to scan electrodes $Y_1$ to $Y_n$ and sustain electrodes $X_1$ to $X_n$ and an address driving circuit 15 for applying a driving voltage to address electrodes $A_1$ to $A_m$ in each period in accordance with the present invention. The driving circuits and the PDP coupled thereto configure a plasma display.

The wall charges formed in the sustain period are eliminated in the reset period. Discharge cells to be displayed are selected from among the discharge cells in the address period. The discharge cells selected in the address period are discharged in the sustain period.

In the sustain period, sustaining is performed by a difference between the wall voltage caused by the wall charges formed in the discharge cells selected in the address period and the voltage formed by the sustain pulse applied to the scan electrode and the sustain electrode. Voltage $V_s$ is applied to scan electrodes $Y_1$ to $Y_n$ at the last sustain pulse in the sustain period, and a reference voltage (assumed as 0V in FIG. 4) is applied to sustain electrodes $X_1$ to $X_n$. The selected discharge cell is discharged between scan electrode $Y_j$ and sustain electrode $X_j$, and negative and positive wall charges are respectively formed on scan electrode $Y_j$ and sustain electrode $X_j$.

In the reset period, a ramp voltage which gradually falls from voltage $V_q$ to voltage $V_n$ is applied to scan electrodes $Y_1$ to $Y_n$ after the last sustain pulse is applied in the sustain period, and reference voltage 0V is applied to address electrodes $A_1$ to $A_m$ and sustain electrode $X_j$.

In general, when the voltage between scan electrode Y and address electrode A or between scan electrode Y and sustain electrode X is greater than the discharge firing voltage, a discharge occurs between scan electrode Y and address electrode A or between scan electrode Y and sustain electrode X, and the discharge firing voltage is varied according to states of the discharge cells. Therefore, in the first exemplary embodiment, voltage Vn has a value for allowing all the discharge cells to be discharged from address electrodes $A_1$ to $A_m$ to scan electrodes $Y_1$ to $Y_n$. All the discharge cells include discharge cells which are provided at an area that can influence displaying a screen on the PDP.

Figure 3:
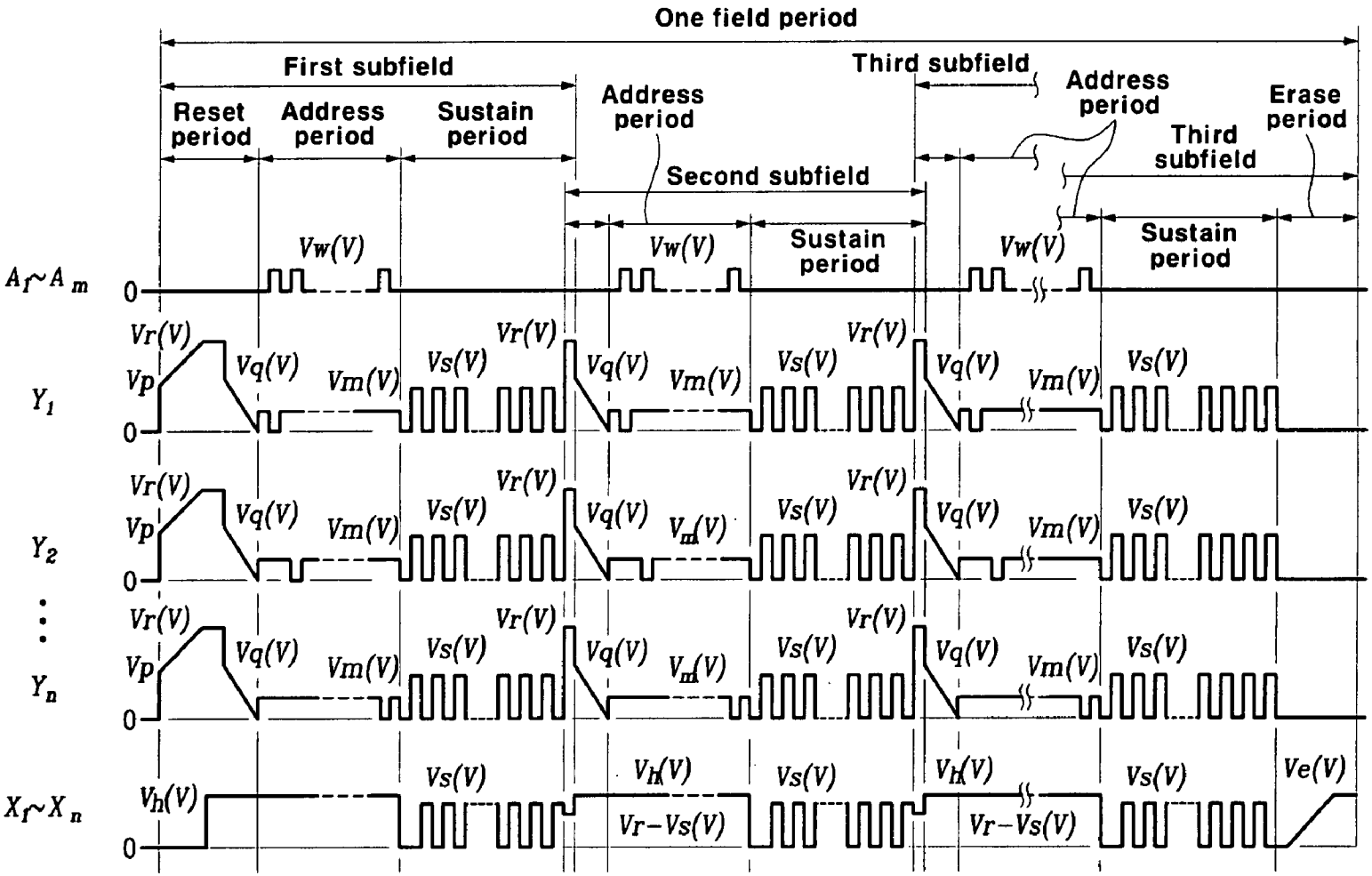
FIG.3 (Prior Art)
FIG. 3 shows a conventional PDP driving waveform diagram.

As given in Equation 1, the difference $V_{A\text{-}Y,reset}$ between voltage 0V applied to address electrodes $A_1$ to $A_m$ and voltage $V_n$ applied to scan electrodes $Y_1$ to $Y_n$ is established to be greater than a maximum discharge firing voltage $V_{f,MAX}$ from among the discharge firing voltages. In this instance, it is desirable for the size $|V_n|$ of voltage $V_n$ to be less than voltage $V_r$ since wall charges can be formed when voltage $V_{A\text{-}Y,reset}$ is very big in the same manner of voltage Vr of the driving waveform of FIG. 3.

$$V_{A\text{-}Y,reset}=|V_n|\geqq V_{f,MAX} \qquad \text{Equation 1}$$

Hence, a weak discharge is generated between sustain electrodes $X_1$ to $X_n$ and scan electrodes $Y_1$ to $Y_n$ and between address electrodes $A_1$ to $A_m$ and scan electrodes $Y_1$ to $Y_n$ because of the falling ramp voltage. In the case of the discharge cell selected in the previous subfield, the wall charges are erased by the weak discharge since the wall charges are formed on scan electrode $Y_j$, sustain electrode $X_j$, and address electrode $A_j$. In this instance, since a large amount of wall charges are not formed in the discharge cell, most of the wall charges formed in the discharge cell are erased, and only a predetermined amount of wall charges which can delete the non-uniformity between the discharge cells remain. In the case of discharge cells which are not selected in the previous subfield, the wall charges which can only solve the non-uniformity between the discharge cells are formed by the weak discharge caused by the falling ramp voltage, or the wall charges are rarely formed.

Accordingly, most of the wall charges of all the discharge cells are erased when passing through the reset period according to the first exemplary embodiment of the present invention.

In the address period, the voltages at scan electrodes $Y_1$ to $Y_n$ and sustain electrodes $X_1$ to $X_n$ are maintained at $V_a$ and $V_e$ respectively, and voltages are applied to scan electrodes $Y_1$ to $Y_n$ and address electrodes $A_1$ to $A_m$ so as to select discharge cells to be displayed. That is, negative voltage $V_{sc}$ is applied to scan electrode $Y_1$ of the first row, and positive voltage $V_w$ is applied to address electrode $A_1$ which is concurrently provided on the discharge cell to be displayed in the first row. Voltage $V_{sc}$ corresponds to voltage $V_n$ in FIG. 4.

Accordingly, as given in Equation 2, the voltage difference $V_{A\text{-}Y,address}$ between address electrode $A_i$ and scan electrode $Y_1$ in the discharge cell selected in the address period always becomes greater than the maximum discharge firing voltage $V_{f,MAX}$, and the voltage difference between sustain electrode $X_1$ to which voltage $V_e$ is applied and scan electrode $Y_1$ becomes greater than the maximum discharge firing voltage $V_{f,MAX}$.

$$V_{A\text{-}Y,address}=V_{A\text{-}Y,reset}+V_w\geqq V_{f,MAX} \qquad \text{Equation 2}$$

Therefore, addressing is generated between address electrode $A_i$ and scan electrode $Y_1$ and between sustain electrode $X_1$ and scan electrode $Y_1$ in the discharge cell formed by address electrode $A_i$ to which voltage $V_w$ is applied and scan electrode $Y_1$ to which voltage $V_{sc}$ is applied. As a result, positive wall charges are formed on scan electrode $Y_1$ and negative wall charges are formed on sustain electrode $X_1$ and address electrode $A_i$.

Next, voltage $V_{sc}$ is applied to scan electrode $Y_2$ in the second row, and voltage $V_w$ is applied to address electrode $A_i$ provided on the discharge cell to be displayed in the second row. As a result, addressing is generated in the discharge cell formed by address electrode $A_i$ to which voltage $V_w$ is applied and scan electrode $Y_1$ to which voltage $V_{sc}$ is applied, and hence, the wall charges are formed in the discharge cell. In a like manner, voltage $V_{sc}$ is sequentially applied to scan electrodes $Y_3$ to $Y_n$ in the residual rows, and voltage $V_w$ is applied to address electrodes provided on the discharge cells to be displayed, thereby forming the wall charges.

In the sustain period, voltage $V_s$ is applied to scan electrodes $Y_1$ to $Y_n$ and reference voltage 0V is applied to sustain electrodes $X_1$ to $X_n$. The voltage between scan electrode $Y_j$ and sustain electrode $X_j$ exceeds the discharge firing voltage in the discharge cell selected in the address period since the wall voltage caused by the positive wall charges of scan electrode $Y_j$ and the negative wall charges of sustain electrode $X_j$ formed in the address period is added to voltage $V_s$. Therefore, sustaining is generated between scan electrode $Y_j$ and sustain electrode $X_j$. Negative and positive wall charges are respectively formed on scan electrode $Y_j$ and sustain electrode $X_j$ of the discharge cell on which the sustaining is generated.

Next, 0V is applied to scan electrodes $Y_1$ to $Y_n$ and voltage $V_s$ is applied to sustain electrodes $X_1$ to $X_n$. In the previous discharge cell in which the sustaining is generated, the voltage between sustain electrode $X_j$ and scan electrode $Y_j$ exceeds the discharge firing voltage since the wall voltage caused by the positive wall charges of sustain electrode $X_j$ and the negative wall charges of scan electrode $Y_j$ formed in the previous sustaining is added to voltage $V_s$. Therefore, the sustaining is generated between scan electrode $Y_j$ and sustain electrode $X_j$, and the positive and negative wall charges are respectively formed on scan electrode $Y_j$ and sustain electrode $X_j$ of the discharge cell in which the sustaining is generated.

In a like manner, a voltages Vs and 0V are alternately applied to scan electrodes $Y_1$ to $Y_n$ and sustain electrodes $X_1$ to $X_n$ to maintain the sustaining. As described, the last sustaining is generated while voltage Vs is applied to scan electrodes $Y_1$ to $Y_n$ and 0V is applied to sustain electrodes $X_1$ to $X_n$. A subfield which starts from the above-noted reset period is provided after the last sustaining.

In the first exemplary embodiment, the addressing is generated when no wall charges are formed in the reset period, by allowing the voltage difference between the address electrode and the scan electrode of the discharge cell to be displayed in the address period to be greater than the maximum discharge firing voltage. Hence, the problem of worsening the margins is removed since the addressing is not influenced by the wall charges formed in the reset period. The amount of discharging is reduced in the reset period compared to the prior art since no wall charges are used in the addressing, and there is no need of forming the wall charges by using the rising ramp voltage in the reset period in the same manner of the prior art. Therefore, the contrast ratio is improved since the amount of discharges by the reset period is reduced in the discharge cells which do not emit light. Further, the maximum voltage applied to the PDP is lowered since the voltage $V_r$ is eliminated of FIG. 3.

The circuit for driving scan electrodes is simplified since voltages $V_{sc}$, $V_n$ can be supplied by the same power source by making voltages $V_{sc}$, $V_n$ correspond to each other. In addition, the addressing is generated irrespective of the wall charges since the voltage difference between the address electrode and the scan electrode in the selected discharge cell can be greater than the maximum discharge firing voltage by greater than voltage $V_w$.

In the first exemplary embodiment, the reference voltage is established to be 0V, and it can further be set to be other voltages. When it is possible to allow the difference between voltages $V_w$ and $V_{sc}$ to be greater than the maximum discharge firing voltage, voltage $V_{sc}$ can be different from voltage $V_n$.

In FIG. 4, voltage $V_e$ applied to sustain electrodes $X_1$ to $X_n$ in the address period is set to be a positive voltage. Voltage $V_e$ can be varied if a discharge can be generated between scan electrode $Y_j$ and sustain electrode $X_j$ by the discharge between scan electrode $Y_j$ and address electrode $A_i$ in the address period. That is, voltage $V_e$ can be 0V or a negative voltage.

A PDP driving method for solving a problem which may occur in the first exemplary embodiment of the present invention will now be described.

In the PDP driving waveform as shown in FIG. 4, positive wall charges can be formed on scan electrodes $Y_1$ to $Y_n$ since a ramp waveform falling to negative voltage $V_n$ is applied in the reset period. Further positive wall charges can be formed when negative voltage $V_{sc}$ is sequentially applied to scan electrodes $Y_1$ to $Y_n$ in the address period in the cell wherein the positive wall charges are accumulated on scan electrodes $Y_1$ to $Y_n$. Also, the positive wall charges are maintained when a ramp voltage waveform falling in the reset period is applied in the case that the cell wherein the positive wall charges are accumulated on scan electrodes $Y_1$ to $Y_n$ is not selected in the address period. Since the small amount of positive wall charges provided on scan electrodes $Y_1$ to $Y_n$ are not reset during resetting in the reset period, addressing in the next subfield may not be well executed.

FIGS. 5 to 8 show PDP driving waveform diagrams for erasing the positive wall charges which can be formed on scan electrodes $Y_1$ to $Y_n$ in the case of the waveform of FIG. 4.

Figure 5:
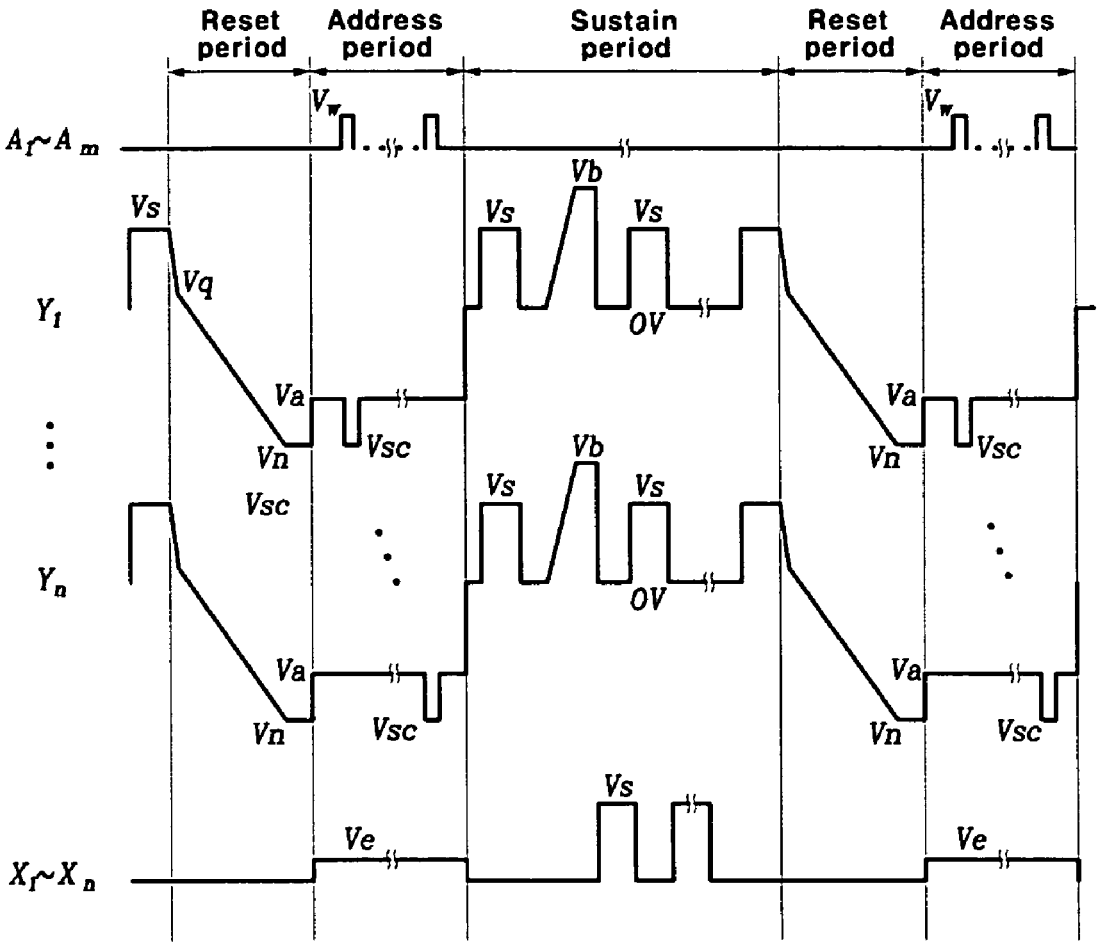
FIG. 5 shows a PDP driving waveform diagram according to a second exemplary embodiment of the present invention.

FIG. 5 shows a PDP driving waveform diagram according to a second exemplary embodiment of the present invention. As shown, the driving waveform according to the second exemplary embodiment of the present invention correspond to those of FIG. 4, and a predetermined ramp waveform is further applied to scan electrodes $Y_1$ to $Y_n$ in the sustain period of FIG. 4. That is, when voltage Vs is alternately applied between scan electrodes $Y_1$ to $Y_n$ and sustain electrodes $X_1$ to $X_n$ in the sustain period to perform sustaining, a ramp waveform of FIG. 5 is applied to scan electrodes $Y_1$ to $Y_n$ between the first period of applying voltage $V_s$ to scan electrodes $Y_1$ to $Y_n$ and the second period of applying voltage $V_s$ to sustain electrode after the first period. The ramp waveform influences no cells selected during the address period (no discharge is generated when the positive voltage is applied since the negative wall charges are accumulated on the scan electrode by application of the sustain voltage $V_s$) since the ramp waveform is applied again to scan electrodes $Y_1$ to $Y_n$ after sustain voltage $V_s$ is applied to scan electrodes $Y_1$ to $Y_n$, and since a weak discharge is generated on the cell which is not selected during the address period and in which the positive wall charges are accumulated on the scan electrode as described above (since the positive wall charges are formed on the scan electrode, a discharge occurs when a positive voltage is applied to the scan electrode), a small amount of negative wall charges are accumulated on the scan electrode of the cell which is not selected during the address period, and a reset operation is performed when a falling ramp is applied in the reset period. Accordingly, no malfunction is generated in the addressing of the next subfield. In this instance, the ramp waveform is a voltage which rises to predetermined voltage $V_b$ which is greater than the sustain voltage $V_s$ so as to generate a weak discharge. That is, sustain voltage $V_s$ applies an appropriate voltage to the scan electrode so that the weak discharge may occur in the discharge cell with formed positive wall charges. The ramp waveform is applied immediately after the sustain voltage is applied to the scan electrode in FIG. 5, but the ramp waveform can be applied to scan electrodes $Y_1$, $Y_n$ in any interval of sustain voltages $V_s$ alternately applied to the scan electrode and the sustain electrode. Also, the ramp waveform can be applied at least once in the sustain period.

FIG. 5 illustrates applying the ramp waveform. However, a resistor-capacitor (RC) resonance waveform, a floating waveform, and a step form waveform which gradually rise can also be applied in addition to the ramp waveform to thus obtain the same effect as that of FIG. 5.

Figure 6:
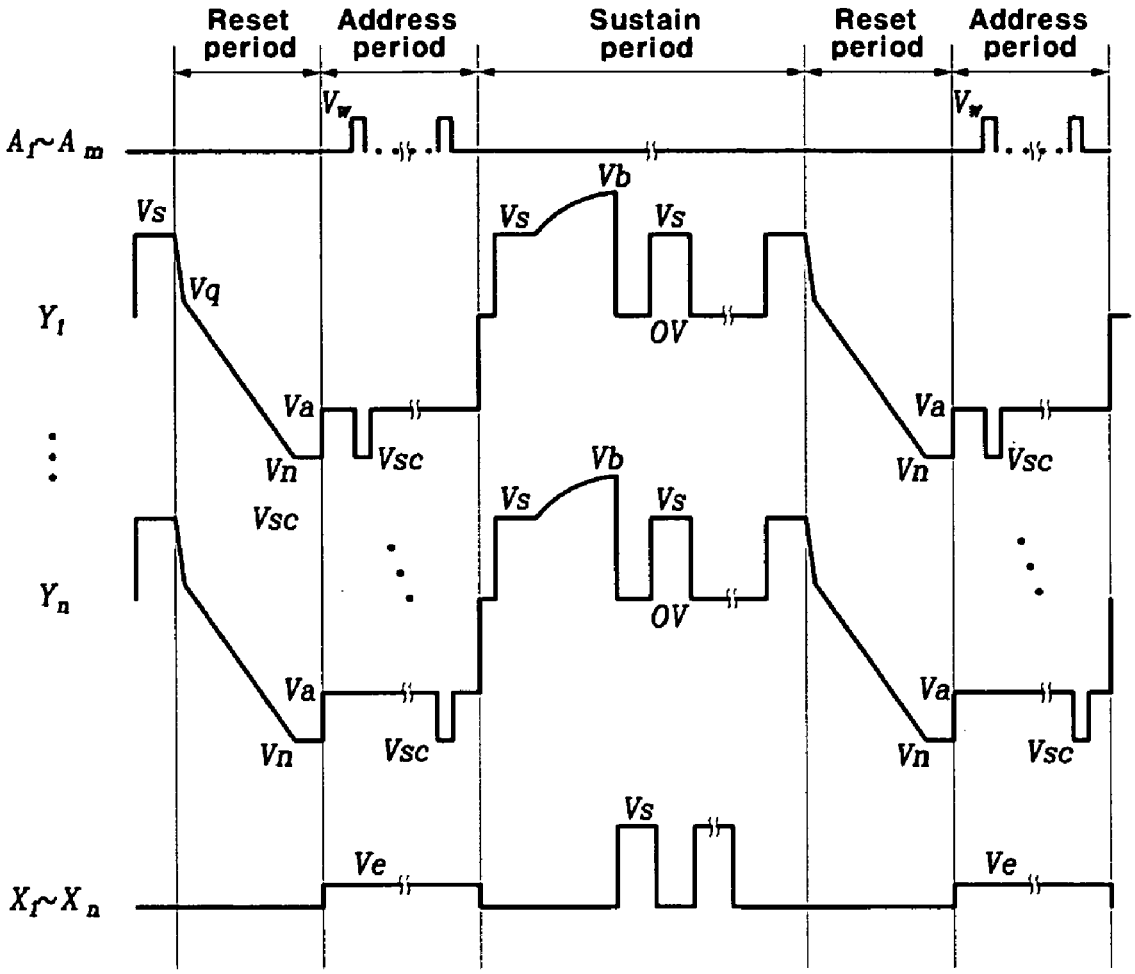
FIG. 6 shows a PDP driving waveform diagram according to a third exemplary embodiment of the present invention.

FIG. 6 shows a PDP driving waveform diagram according to a third exemplary embodiment of the present invention. As shown, differing from FIG. 5, sustain voltage $V_s$ is applied to scan electrodes $Y_1$ and $Y_n$ and an RC resonance waveform which rises to voltage $V_b$ is applied thereto in the sustain period. In this instance, in the period of applying sustain voltage $V_s$ to scan electrodes $Y_1$ to $Y_n$, sustaining is generated in the cell which is selected in the address period and no sustaining is generated in the cell which is not selected in the address period, and a weak discharge is generated in the cell which is not selected in the address period and in which the positive wall charges are accumulated on the scan electrode when the RC resonance waveform is applied. In this instance, voltage $V_b$ applies an appropriate voltage to the scan electrode so that a weak discharge may be generated in the discharge cell with the formed positive wall charges. Hence, the negative wall charges are accumulated on the scan electrode which is not selected in the address period, the scan electrode is reset by a ramp waveform of the next reset period, and no malfunction is generated when the scan electrode is selected in the next address period. Also, the cell which is selected in the address period when applying the RC resonance waveform is not influenced by the RC resonance waveform since the RC resonance waveform is applied after the sustaining. The waveform for applying sustain voltage Vs and instantly applying the RC resonance waveform can be applied to scan electrodes $Y_1$ to $Y_n$ anytime during the sustain period, at least once.

Figure 7:
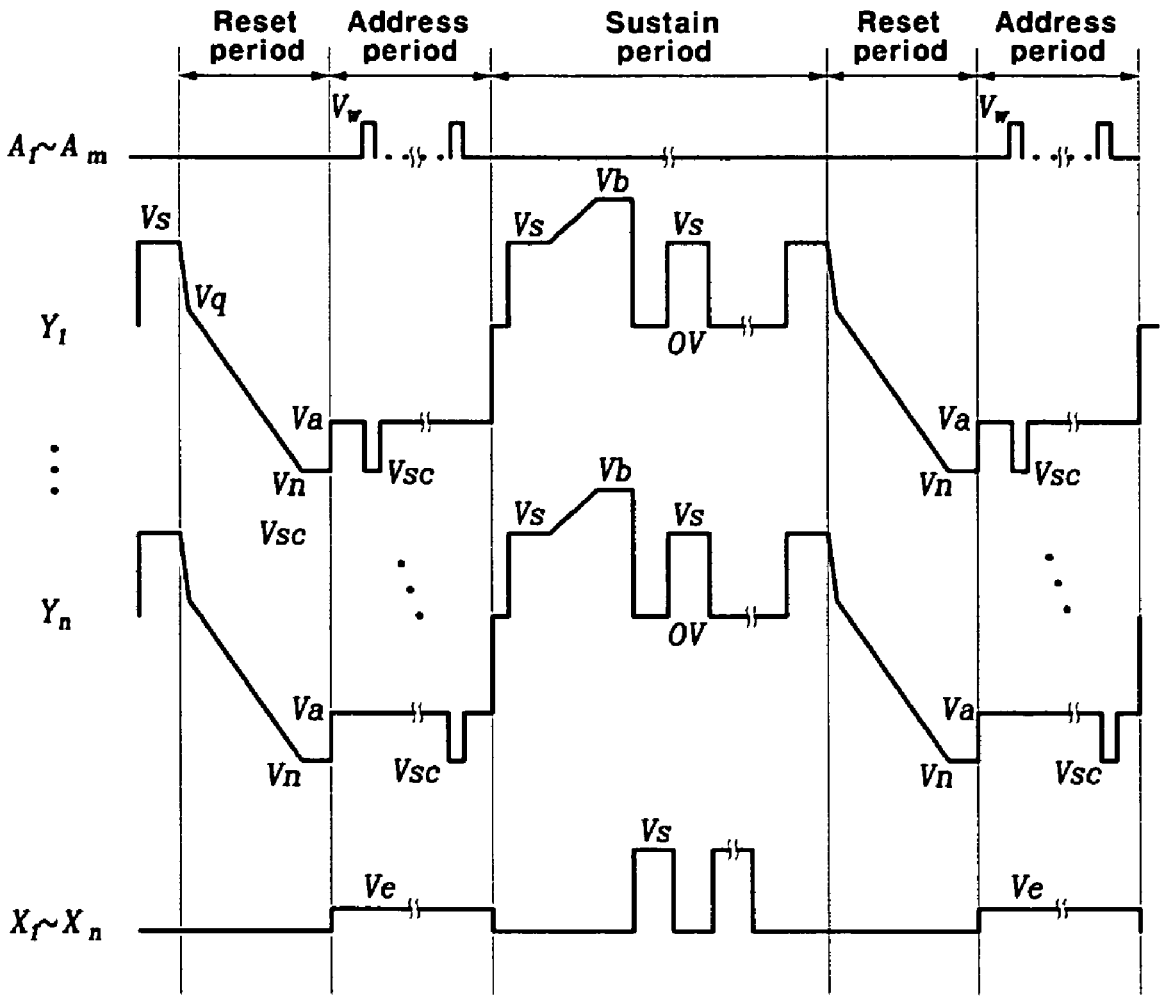
FIG. 7 shows a PDP driving waveform diagram according to a fourth exemplary embodiment of the present invention.

FIG. 7 shows a PDP driving waveform diagram according to a fourth exemplary embodiment of the present invention. As shown, the fourth exemplary embodiment corresponds to the third exemplary embodiment of FIG. 6 except that a ramp waveform rising to voltage $V_b$ is applied after sustain voltage $V_s$ is applied to scan electrodes $Y_1$, $Y_n$. By applying the above-noted ramp waveform, the negative wall charges are accumulated on the scan electrode of the cell which is not selected during the address period and in which the positive wall charges are accumulated. Through this process, resetting is performed by a ramp waveform of the next reset period, and the scan electrode is addressed when selected in the next address period. Further, the cell which is selected in the address period is not influenced by the ramp waveform since the ramp waveform is applied after the sustaining at the time of applying the ramp waveform. The ramp waveform of FIG. 7 can be applicable to scan electrodes $Y_1$, $Y_n$ at least once at any time of the sustain period.

Figure 8:
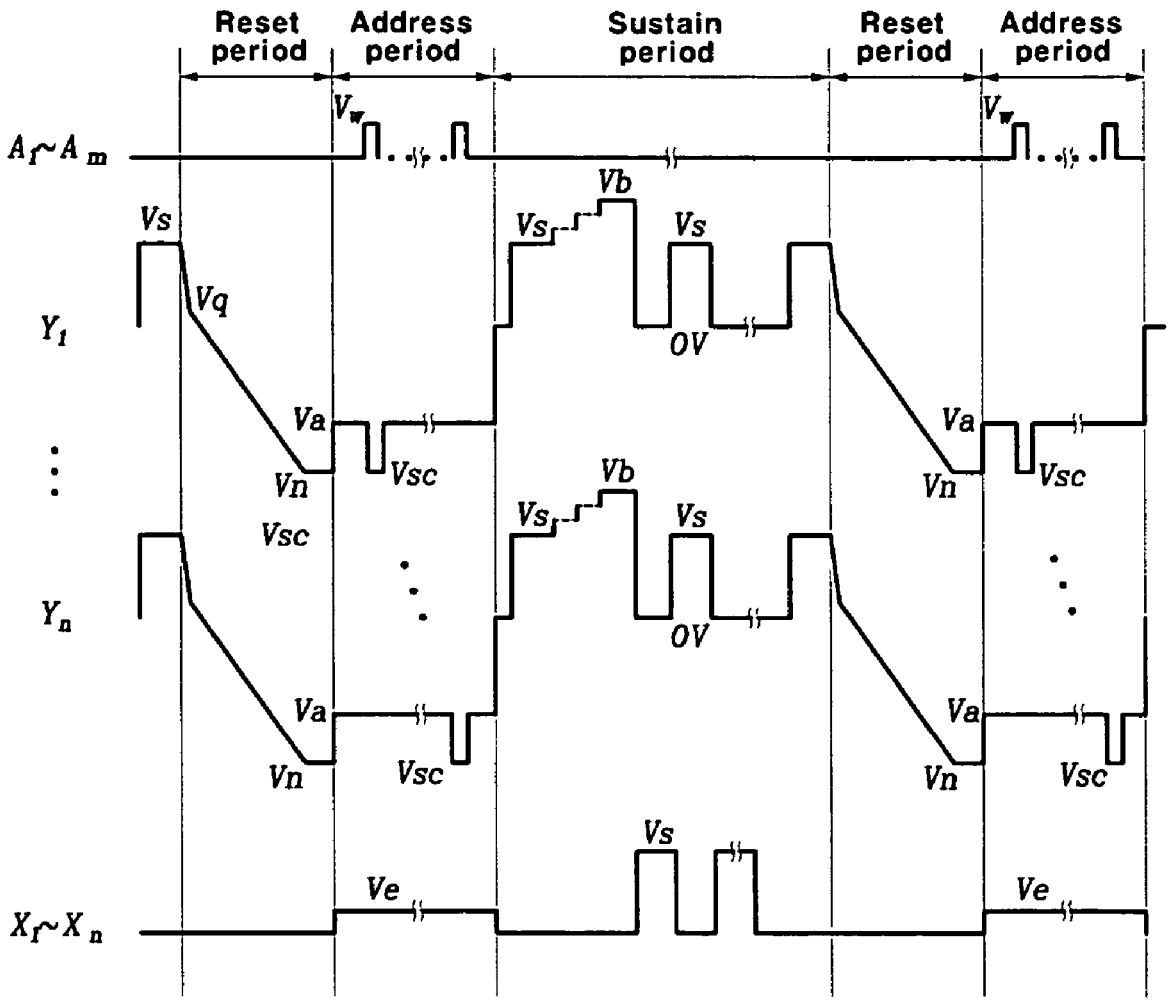
FIG. 8 shows a PDP driving waveform diagram according to a fifth exemplary embodiment of the present invention.

FIG. 8 shows a PDP driving waveform diagram according to a fifth exemplary embodiment of the present invention. As shown, the fifth exemplary embodiment corresponds to the third exemplary embodiment of FIG. 6 except that a floating waveform is applied after sustain voltage $V_s$ is applied to scan electrodes $Y_1$, $Y_n$. By applying the floating waveform after varying the constant voltage, the negative wall charges are accumulated on the scan electrode of the cell which is not selected in the address period and in which the positive wall charges are accumulated on the scan electrode. Through this process, resetting is performed by the ramp waveform of the next reset period, and the scan electrode is addressed when selected during the next address period. Also, the cell which is selected in the address period is not influenced by the floating waveform at the time of applying the floating waveform since the floating waveform is applied after the sustaining. The floating waveform of FIG. 7 can be applied to scan electrodes $Y_1$ to $Y_n$ at any time of the sustain period, at least once.

Figure 9:
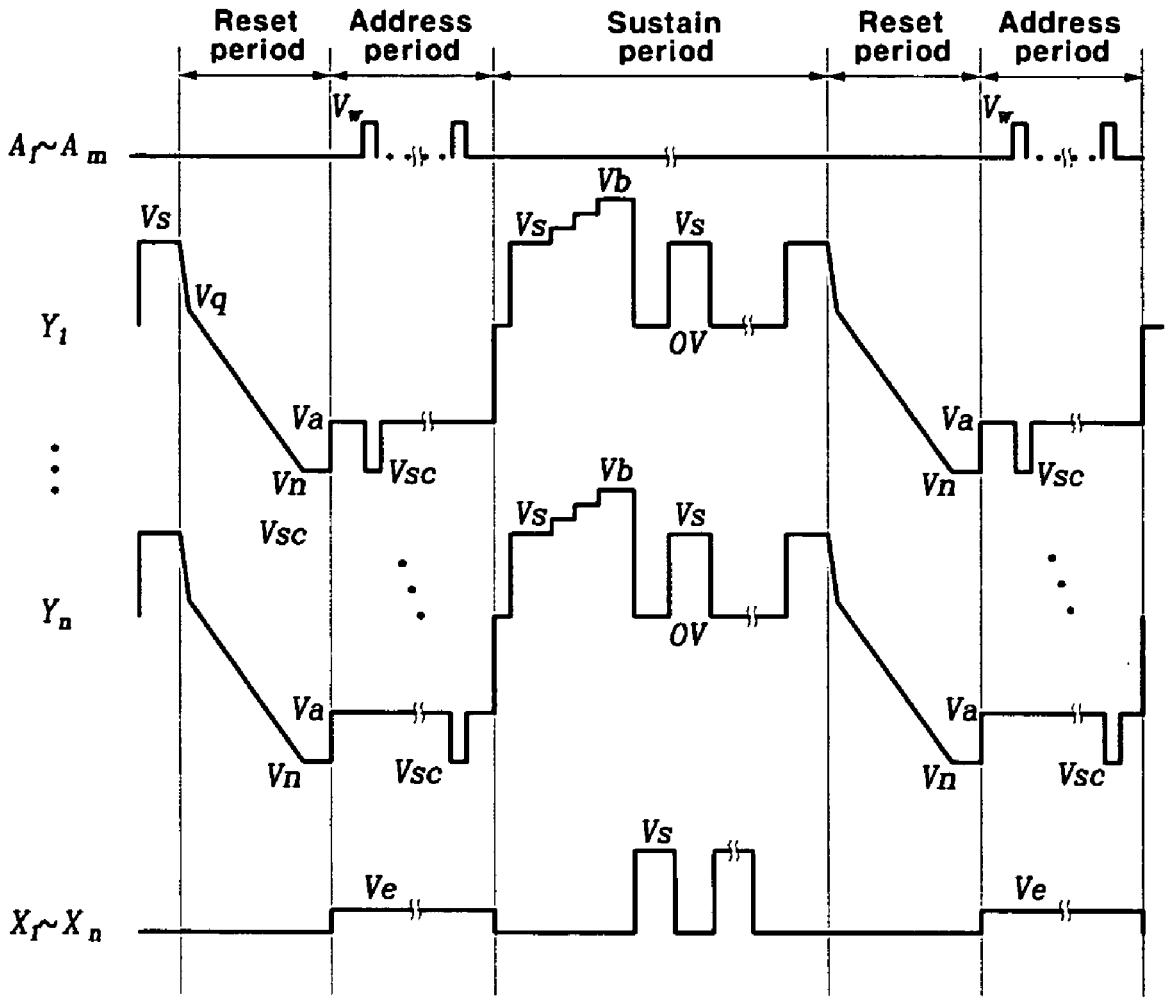
FIG. 9 shows a PDP driving waveform diagram according to a sixth exemplary embodiment of the present invention.

FIG. 9 shows a PDP driving waveform diagram according to a sixth exemplary embodiment of the present invention where a staircase waveform for applying and maintaining a constant voltage is applied, from which the same effects are obtained.

The applied ramp waveform, the RC resonance waveform, the floating waveform, and the staircase waveform of FIGS. 5 to 9 are generated by configuration of simple circuits, and no corresponding description will be provided since they are well known to a person skilled in the art.

According to the present invention, the problem of worsening the margins because of loss of the wall charges is eliminated since the addressing is not influenced by the wall charges formed in the reset period. The contrast ratio is improved since the amount of discharges during the reset period is reduced in the discharge cell which emits no light. Also, the maximum voltage applied to the PDP is reduced.

In addition, by applying a predetermined waveform during the sustain period, the positive wall charges which can exist in the scan electrode of the cell which is not selected during the address period are converted to the negative wall charges, and resetting is performed in the next reset period, and accordingly, the next addressing is performed well.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel having a plurality of first electrodes and second electrodes extending in parallel on a first substrate, and a plurality of third electrodes which cross the first and second electrodes and are on a second substrate, wherein a plurality of discharge cells are formed by the first electrodes and second electrodes, and the third electrodes, and respective driving circuits for the first electrodes, second electrodes and third electrodes, wherein a field is divided into a plurality of subfields and then driven, each of the subfields including a reset period, an address period, and a sustain period, and the method comprising:

applying a ramp voltage which gradually falls from a first voltage to a second voltage to a first electrode among the first electrodes, during the reset period;

applying a third voltage and a fourth voltage respectively to the first electrode and a third electrode among the third electrodes of a discharge cell to be selected from among the discharge cells, during the address period; and alternately applying a first voltage waveform to the first electrode and a second electrode among the second electrodes, and applying at least one second voltage waveform to the first electrode, during the sustain period, wherein the first voltage waveform is different from the second voltage waveform, and wherein the second voltage waveform comprises a fifth voltage and rises from the fifth voltage to a sixth voltage.

2. The method of claim 1, wherein the second voltage waveform which rises to the sixth voltage from the fifth voltage comprises a floating waveform for repeatedly performing floating after a constant voltage variation.

3. The method of claim 1, wherein the second voltage waveform which rises to the sixth voltage from the fifth voltage comprises a staircase waveform for repeatedly maintaining a voltage after a constant voltage variation.

4. The method of claim 1, wherein no further wall charges are formed in the discharge cell during the reset period.

5. A method for driving a plasma display panel having a plurality of first electrodes and second electrodes extending in parallel on a first substrate, and a plurality of third electrodes which cross the first and second electrodes and are on a second substrate, wherein a plurality of discharge cells are formed by the first electrodes and second electrodes, and the third electrodes, and respective driving circuits for the first electrodes, second electrodes and third electrodes, wherein a field is divided into a plurality of subfields and then driven, each of the subfields including a reset period, an address period, and a sustain period, and the method comprising:

applying a ramp voltage which gradually falls from a first voltage to a second voltage to a first electrode among the first electrodes, during the reset period:

applying a third voltage and a fourth voltage respectively to the first electrode and a third electrode among the third electrodes of a discharge cell to be selected from among the discharge cells, during the address period; and alternately applying a fifth voltage to the first electrode and a second electrode among the second electrodes, and applying at least one sixth voltage which rises from the fifth voltage after applying the fifth voltage to the first electrode, during the sustain period, wherein a waveform which rises to the sixth voltage from the fifth voltage is a resistor-capacitor resonance waveform.

6. A method for driving a plasma display panel having a plurality of first electrodes and second electrodes extending in parallel on a first substrate, and a plurality of third electrodes which cross the first and second electrodes and are on a second substrate, wherein a plurality of discharge cells are formed by the first electrodes and second electrodes, and the third electrodes, and respective driving circuits for the first electrodes, second electrodes and third electrodes, wherein a field is divided into a plurality of subfields and then driven, each of the sub fields including a reset period, an address period, and a sustain period, and the method comprising:

applying a ramp voltage which gradually falls from a first voltage to a second voltage to a first electrode among the first electrodes, during the reset period;

applying a third voltage and a fourth voltage respectively to the first electrode and a third electrode among the third electrodes of a discharge cell to be selected from among the discharge cells, during the address period; and alternately applying a fifth voltage to the first electrode and a second electrode among the second electrodes, and applying at least one sixth voltage which rises from the fifth voltage after applying the fifth voltage to the first electrode, during the sustain period, wherein a waveform which rises to the sixth voltage from the fifth voltage is a ramp waveform.

7. A method for driving a plasma display panel having a plurality of first electrodes and second electrodes extending in parallel on a first substrate, and a plurality of third electrodes on a second substrate, the plurality of third electrodes crossing the first electrodes and the second electrodes, wherein a plurality of discharge cells are formed by the first electrodes and second electrodes and a the third electrodes, the method comprising:

during a sustain period, alternately applying a first voltage waveform to a first electrode among the first electrodes and a second electrode among the second electrodes, and applying at least one second voltage waveform to the first electrode, wherein the first voltage waveform is different from the second voltage waveform, and wherein the second voltage waveform comprises a first voltage and rises from the first voltage to a second voltage, thereby converting positive wall charges provided on the first electrode of a discharge cell among the plurality of discharge cells not selected in the address period for selecting a discharge cell among the plurality of discharge cells to be selected into negative wall charges.

8. The method of claim 7, wherein the second voltage waveform which rises to the second voltage from the first voltage comprises a floating waveform for repeatedly performing floating after a constant voltage variation.

9. The method of claim 7, wherein the second voltage waveform which rises to the second voltage from the first voltage comprises a staircase waveform for repeatedly maintaining a voltage after a constant voltage variation.

10. A method for driving a plasma display panel having a plurality of first electrodes and second electrodes extending in parallel on a first substrate, and a plurality of third electrodes on a second substrate, the plurality of third electrodes crossing the first electrodes and the second electrodes, wherein a plurality of discharge cells are formed by the first electrodes and second electrodes, and the third electrodes, the method comprising:

during a sustain period, alternately applying a first voltage to a first electrode among the first electrodes and a second electrode among the second electrodes, and applying at least one second voltage which rises from the first voltage after applying the first voltage to the first electrode, thereby converting positive wall charges provided on the first electrode of a discharge cell among the plurality of discharge cells not selected in the address period for selecting a discharge cell among the plurality of discharge cells to be selected into negative wall charges by applying the second voltage, wherein a waveform which rises to the second voltage from the first voltage is a resistor-capacitor resonance waveform.

11. A method for driving a plasma display panel having a plurality of first electrodes and second electrodes extending in parallel on a first substrate, and a plurality of third electrodes on a second substrate, the plurality of third electrodes crossing the first electrodes and the second electrodes, wherein a plurality of discharge cells are formed by the first electrodes and second electrodes, and the third electrodes, the method comprising:

during a sustain period, alternately applying a first voltage to a first electrode among the first electrodes and a second electrode among the second electrodes, and applying at least one second voltage which rises from the first voltage after applying the first voltage to the first electrode, thereby converting positive wall charges provided on the first electrode of a discharge cell among the plurality of discharge cells not selected in the address period for selecting a discharge cell among the plurality of discharge cells to be selected into negative wall charges by applying the second voltage, wherein a waveform which rises to the second voltage from the first voltage is a ramp waveform.

* * * * *

UNITED STATES PATENT AND TRADEMARK OFFICE

CERTIFICATE OF CORRECTION

PATENT NO. : 7,446,735 B2
APPLICATION NO. : 10/947106
DATED : November 4, 2008
INVENTOR(S) : Jin-Sung Kim It is certified that error appears in the above-identified patent and that said Letters Patent is hereby corrected as shown below:

In the Claims

| | |
|---|---|
| Column 10, line 65, Claim 5 | Delete "period:",<br>Insert --period;-- |
| Column 11, line 20, Claim 6 | Delete "sub fields",<br>Insert --subfields-- |
| Column 11, line 42, Claim 7 | Delete "electrodes and a",<br>Insert --electrodes, and-- |

Signed and Sealed this

Twenty-fourth Day of February, 2009

JOHN DOLL
*Acting Director of the United States Patent and Trademark Office*